US006834651B1

(12) United States Patent
Murdock et al.

(10) Patent No.: US 6,834,651 B1
(45) Date of Patent: Dec. 28, 2004

(54) INTERCOURSE AIDING APPARATUS

(76) Inventors: Scott W. Murdock, 35603 Electra St., Sterling Heights, MI (US) 48312; Pamela J. Murdock, 35603 Electra St., Sterling Heights, MI (US) 48312

( * ) Notice: Subject to any disclaimer, the term of this patent is extended or adjusted under 35 U.S.C. 154(b) by 0 days.

(21) Appl. No.: 10/388,564

(22) Filed: Mar. 17, 2003

(51) Int. Cl.[7] ..... A61G 15/00
(52) U.S. Cl. ..... 128/845; 128/846; 600/38
(58) Field of Search ..... 128/845, 846, 128/869, 870, 876; 410/100; 5/620, 624, 625, 627; 224/314, 318

(56) References Cited

U.S. PATENT DOCUMENTS

| | | | | |
|---|---|---|---|---|
| 3,894,787 A | | 7/1975 | Withers | |
| 3,897,778 A | | 8/1975 | Forbes-Robinson et al. | |
| 4,742,821 A | | 5/1988 | Wootan | |
| 4,825,855 A | | 5/1989 | Kundson, Jr. | |
| D303,466 S | | 9/1989 | Haggerty et al. | |
| 5,193,955 A | * | 3/1993 | Chou | 410/100 |
| 5,458,447 A | * | 10/1995 | Clason | 400/100 |
| 5,839,137 A | * | 11/1998 | Butler | 5/627 |
| 6,101,652 A | | 8/2000 | Matern, Jr. | |
| 6,209,768 B1 | * | 4/2001 | Boaz | 224/314 |
| 6,363,936 B1 | * | 4/2002 | McCormick et al. | 128/870 |

* cited by examiner

*Primary Examiner*—Michael A. Brown

(57) ABSTRACT

An intercourse aiding apparatus for providing support and leverage on a mattress includes a webbing comprised of a plurality of straps which are attached together. The webbing has a peripheral edge. A plurality of elongate binding members is attached to the peripheral edge. Each of the binding members has a first end and a second end. The first ends are attached to the peripheral edge such that the elongate binding members are spaced from each other. Each of a plurality of securing members is attached to one of the second ends for releasably securing the second ends of the binding members together such that coupled pairs of binding members traverse a lower side of a mattress when the webbing is positioned upon an upper side of the mattress.

2 Claims, 2 Drawing Sheets

INTERCOURSE AIDING APPARATUS

BACKGROUND OF THE INVENTION

1. Field of the Invention

The present invention relates to intercourse aids and more particularly pertains to a new intercourse aid for fulfilling the need for a device designed to enhance and make sexual intercourse more comfortable for partners.

2. Description of the Prior Art

The use of intercourse aids is known in the prior art. U.S. Pat. No. 3,897,778 describes a quick-release buckle and body harness arrangement capable of being clinched around the torso of a patient to slip out has strap portions, which extend when the harness is positioned on each side of the patient. Another type of intercourse aid is U.S. Pat. No. 4,742,821 describes a patient restraint apparatus that allows relative freedom of movement for the patient. U.S. Pat. No. 4,825,855 describes an intercourse aiding apparatus for use in performing intercourse, including a rigid frame supported above a bed. U.S. Pat. No. 6,101,652 describes a foldable pair of leg stirrups for use during sex or a medical examination. U.S. Pat. No. Des. 303,466 describes an ornamental design for a body support design. U.S. Pat. No. 3,896,787 describes therapeutic apparatus for therapeutically assisting the conjugal relationship.

SUMMARY OF THE INVENTION

The object of the present invention is to provide a new intercourse aid that improves body leverage for both the male and the female for improved sexual satisfaction.

Another object of the present invention is to provide a new intercourse aid that would improve the level of confidence and sexual satisfaction of both partners.

To this end, the present invention generally comprises a webbing comprised of a plurality of straps which are attached together. The webbing has a peripheral edge. A plurality of elongate binding members is attached to the peripheral edge. Each of the binding members has a first end and a second end. The first ends are attached to the peripheral edge such that the elongate binding members are spaced from each other. Each of a plurality of securing members is attached to one of the second ends for releasably securing the second ends of the binding members together such that coupled pairs of binding members traverse a lower side of a mattress when the webbing is positioned upon an upper side of the mattress.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty, which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
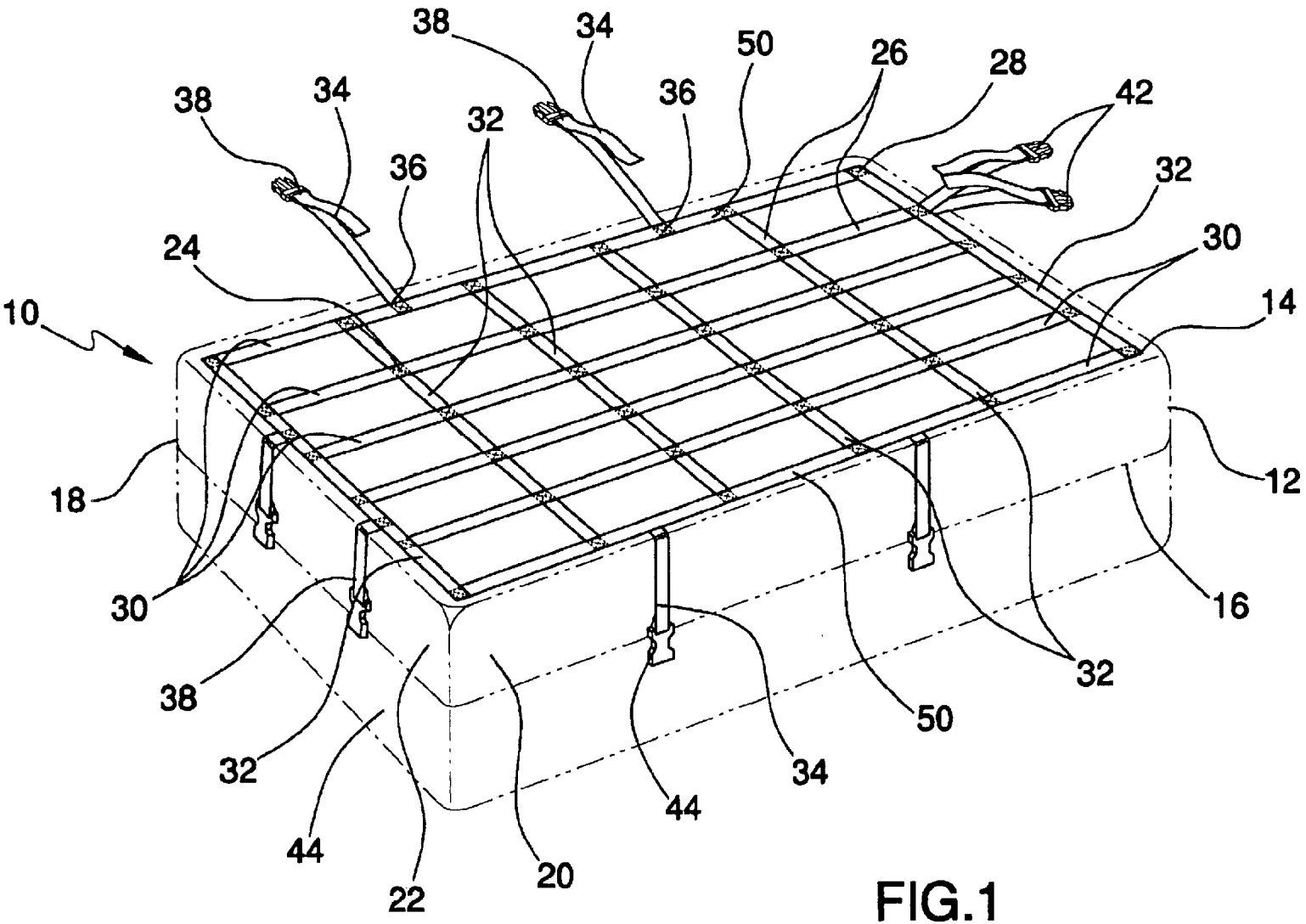
FIG. 1 is a perspective view of an intercourse aiding apparatus according to the present invention.
Figure 2:
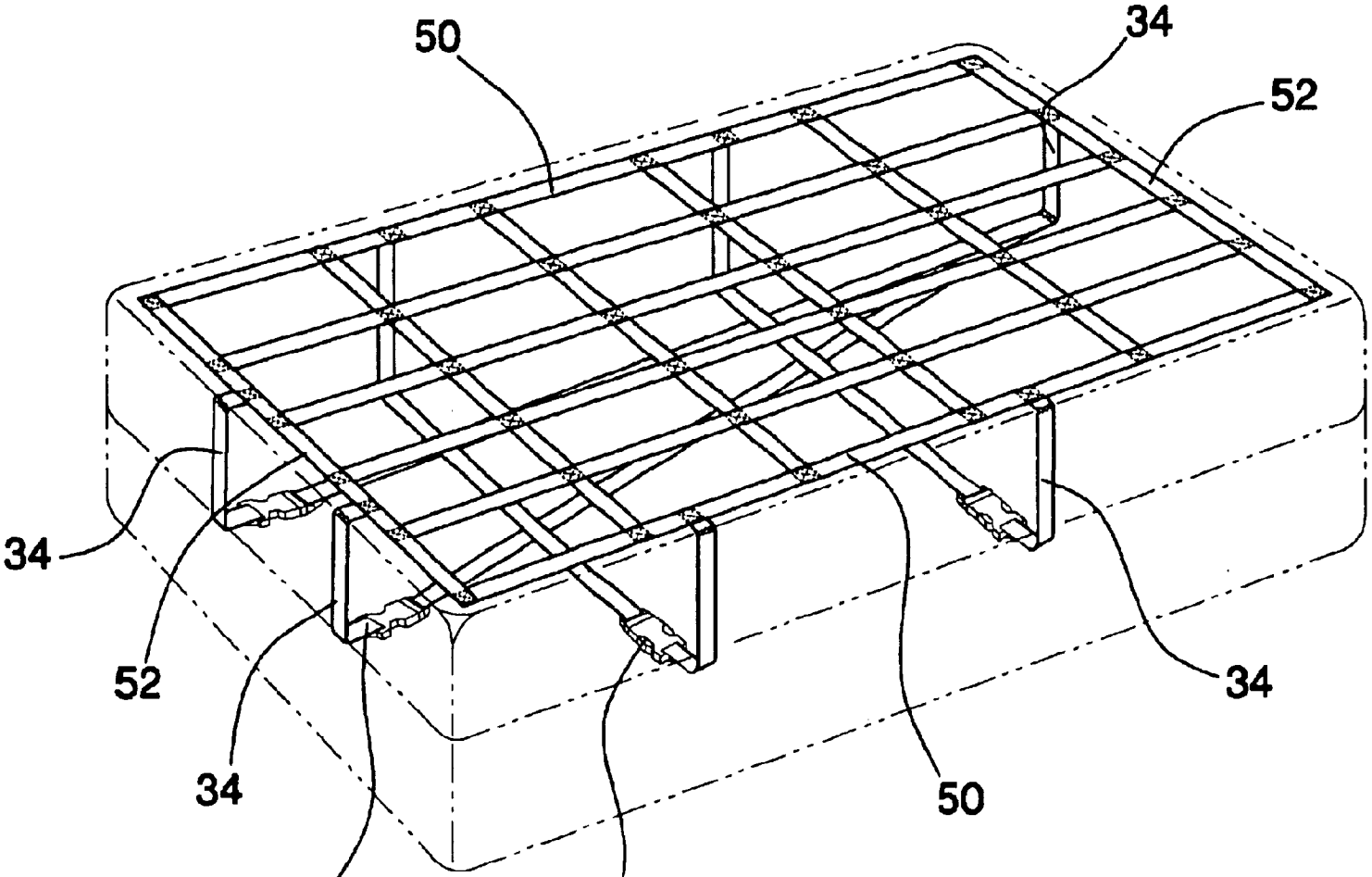
FIG. 2 is a side view of the present invention.

With reference now to the drawings, and in particular to FIGS. 1 and 2 thereof, a new intercourse aid embodying the principles and concepts of the present invention and generally designated by the reference numeral 10 will be described.

As best illustrated in FIGS. 1 and 2, the intercourse aiding apparatus 10 is an apparatus that may be removably positionable on a mattress 12 having an upper side 14, a lower side 16 and a peripheral wall 18. The peripheral wall 18 includes a pair long of sides 20 and a pair of short sides 22. The apparatus 10 includes a webbing 24 comprising a plurality of straps 26. The straps 26 are attached together such that the webbing 24 has a peripheral edge 28. The straps 26 are attached together such that a rectangular matrix is formed of longitudinally aligned ones of the straps 30 and of latitudinally aligned ones of the straps 32. An outer pair of longitudinal straps 50 and an outer pair of latitudinal straps 52 defines the peripheral edge 28 of the matrix. Each of the longitudinally aligned straps 30 has a length substantially equal to the long sides 20 of the mattress 12. Each of the latitudinally aligned straps 32 has a length substantially equal to the short sides 22 of the mattress 12. The straps 26 each preferably comprise a nylon material.

Each of a plurality of elongate binding members 34 is attached to the peripheral edge 28 of the webbing 26. The binding members 34 each have a first end 36 and a second end 38. The first ends 36 are attached to the peripheral edge 28 such that the elongate binding members 34 are spaced from each other. At least one of the elongate binding members 34 is attached to each one of the outer pair of longitudinal straps and the outer pair of latitudinal straps. Ideally, at least two binding members 34 are attached to each of the straps 26 comprising the outer longitudinal straps 50. The binding members 34 each preferably comprise a resiliently elastic material.

Each of a plurality of securing members 40 is attached to one of the second ends 38, or adjacent thereto, for releasably securing the second ends 38 of the binding members 34 together such that selectively coupled pairs of binding members 34 traverse the lower side 16 of the mattress 12 when the webbing 24 is positioned upon the upper side 14 of the mattress 12. The securing members 40 include a plurality of first mating members 42 and a plurality of second mating members 44 releasably securable to each other. Each of the first mating members 42 is attached to one of the second ends 38 of the binding members 34 and each of the second mating members 44 is attached to one of the second ends 38 of the binding members 34 such that the first 42 and second 44 mating members are positioned generally opposite to each other with respect to the webbing 24. The first 42 and second 44 mating members preferably comprise male and female couplers. Alternatively, snaps, buttons, other mechanical fasteners, or hook and loop fasteners may be used.

In use, the webbing 24 is positioned on a mattress 12 so it generally covers the upper side 24 of the mattress 12. The longitudinally aligned straps 30 are preferably aligned in parallel fashion with the long sides 20 of the mattress 12 and the latitudinally aligned straps 32 are preferably aligned in parallel fashion with the short sides 22 of the mattress 12.

Once in place, and positioned as desired by the user, the webbing 24 is secured to the mattress 12 using the binding members 34. The straps 26 of the webbing 24 are used for providing leverage during sexual intercourse to those who require it. The user may place a sheet over the webbing 24 or remove it from the mattress 12 when not in use.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A method for aiding intercourse comprising the steps of:

providing a mattress having an upper side, a lower side and a peripheral wall, the peripheral wall including a pair of long sides and a pair of short sides;

providing a webbing comprising a plurality of straps, said straps being attached together, said webbing having a peripheral edge, said straps being attached together such that a rectangular matrix is formed of longitudinally aligned ones of said straps and of latitudinally aligned ones of said straps, said peripheral edge of said matrix being defined by an outer pair of longitudinal straps and an outer pair of latitudinal straps, each of said longitudinally aligned straps having a length substantially equal to the long sides of said mattress, each of said latitudinally aligned straps having a length substantially equal to the short sides of said mattress;

providing a plurality of elongate binding members each being attached to said peripheral edge of said webbing, each of said binding members having a first end and a second end, each of said first ends being attached to said peripheral edge such that said elongate binding members are spaced from each other, wherein at least one of said elongate binding members is attached to each one of said outer pair of longitudinal straps and said outer pair of latitudinal straps;

providing a plurality of securing members, each of said plurality of securing members being attached to one of said second ends for releasably securing said second ends of said binding members together such that coupled pairs of binding members selectively traverse the lower side of the mattress when said webbing is positioned upon the upper side of the mattress;

positioning said webbing on said mattress so that said webbing generally covers said upper side of said mattress aligning said longitudinally aligned straps in a parallel fashion with said long sides of said latitudinally aligned straps in parallel fashion with said short sides of said mattress;

securing said webbing to said mattress with said binding members; and utilizing said straps for leverage during sexual intercourse.

2. A method for aiding intercourse comprising the steps of:

providing a mattress having an upper side, a lower side and a peripheral wall, the peripheral wall including a pair of long sides and a pair of short sides;

providing a webbing comprising a plurality of straps, said straps being attached together, said webbing having a peripheral edge, said straps being attached together such that a rectangular matrix is formed of longitudinally aligned ones of said straps and of latitudinally aligned ones of said straps, said peripheral edge of said matrix being defined by an outer pair of longitudinal straps and an outer pair of latitudinal straps, each of said longitudinally aligned straps having a length substantially equal to the long sides of said mattress, each of said latitudinally aligned straps having a length substantially equal to the short sides of said mattress, each of said straps comprising a nylon material;

providing a plurality of elongate binding members each being attached to said peripheral edge of said webbing, each of said binding members having a first end and a second end, each of said first ends being attached to said peripheral edge such that said elongate binding members are spaced from each other, wherein at least one of said elongate binding members is attached to each one of said outer pair of longitudinal straps and said outer pair of latitudinal straps, each of said binding members comprising a resiliently elastic material;

providing a plurality of securing members, each of said plurality of securing member being attached to one of said second ends for releasably securing said second ends of said binding members together such that coupled pairs of binding members selectively traverse the lower side of the mattress when said webbing is positioned upon the upper side of the mattress, said securing members including a plurality of first mating members and a plurality of second mating members releasably securable to each other, each of said first mating members being attached to one of said second ends of said binding members and each of said second mating members being attached to one of said second ends of said binding members such that said first and second mating members are positioned generally opposite to each other with respect to said webbing;

positioning said webbing on said mattress so that said webbing generally covers said upper side of said mattress;

aligning said longitudinally aligned straps in a parallel fashion with said long sides of said latitudinally aligned straps in parallel fashion with said short sides of said mattress;

securing said webbing to said mattress with said binding members; and utilizing said straps for leverage during sexual intercourse.

* * * * *